United States Patent [19]

Stenner

[11] Patent Number: 4,912,909

[45] Date of Patent: Apr. 3, 1990

[54] DIRECT MAIL ARTICLE WITH MAILABLE REPLY CARD

[75] Inventor: John W. Stenner, Orange, Conn.

[73] Assignee: Kurt H. Volk, Inc., Milford, Conn.

[21] Appl. No.: 234,997

[22] PCT Filed: Mar. 4, 1988

[86] PCT No.: PCT/US88/00720

§ 371 Date: Jun. 6, 1988

§ 102(e) Date: Jun. 6, 1988

[51] Int. Cl.[4] ..... B65B 11/48

[52] U.S. Cl. ..... 53/429; 53/460; 493/216

[58] Field of Search ..... 53/460, 429, 266 A, 53/206; 493/216, 921, 188, 381; 229/73

[56] References Cited

U.S. PATENT DOCUMENTS

| | | | |
|---|---|---|---|
| 3,557,519 | 1/1971 | Lyon, Jr. | 493/216 X |
| 4,063,398 | 12/1977 | Huffman | 493/216 |
| 4,067,171 | 1/1978 | Herbert et al. | 53/206 X |
| 4,437,852 | 3/1984 | Volk, Jr. et al. | 493/216 |
| 4,455,809 | 6/1984 | Dallaserra | 53/435 |
| 4,543,082 | 9/1985 | Stenner | 493/216 |
| 4,651,920 | 3/1987 | Stenner | 229/70 |
| 4,726,802 | 2/1988 | Volk Jr. | 493/188 |

*Primary Examiner*—James F. Coan

*Attorney, Agent, or Firm*—Davis Hoxie Faithfull & Hapgood

[57] ABSTRACT

A direct mail article (75) comprising an envelope containing at least one separate enclosure sheet (30, 40, 50, 140, 150, 230) and a separate postcard reply device (33, 133) which can be personalized is made from one or more composite sheets (14, 14',114, 214) of a continuous web (10A, 10B, 100) of relatively light-weight paper stock. In the preferred embodiment, the mailing article is formed from two webs (10A, 10B) of light weight paper stock and the postcard reply device (33) of sufficient weight to meet postal regulations is formed by bonding appropriately printed sections 32*a*, 32*b*) of the web together and then separating the enclosure sheets (30, 40, 50) and reply device (33) after both have been folded into the envelope, thus ensuring that mismatching of personalized letters and envelopes does not occur.

32 Claims, 5 Drawing Sheets

DIRECT MAIL ARTICLE WITH MAILABLE REPLY CARD

BACKGROUND OF THE INVENTION

1. Field of the Invention

This invention relates to commercial methods and procedures for preparing large numbers of articles suitable for mailing, each of which comprises an envelope containing one or more separate enclosures. The envelope and enclosures can be made from two separate webs of continuous, pre-printed material and are brought together prior to insertion into the envelope. The invention has particular utility where a mass market direct mailing involving a million or more articles having essentially the same format are to be addressed and mailed to individual recipients. Large-volume mailings of this type are typically undertaken on behalf of businesses soliciting credit card applicants or magazine subscribers, or by charitable or membership organizations seeking contributions or additional members. Similar mailings might be undertaken by governmental organizations or political sub-divisions in connection with taxation, licensing or registration functions. In the commercial field, the use of multiple enclosure mailings, some or all of which have been personalized by inclusion of at least the recipient's name and preferably additional personal data, are believed to have resulted in an increased favorable response to the solicitation.

The terms "personalized" and "personalization" as used throughout this description will be understood by those familiar with the art and include information regarding the recipient's name, address, gender, age, and other data which may be collected from demographic studies.

2. Description of the Related Art

The present invention represents a considerable advancement in the art of direct mail mass mailing campaigns, and particularly that disclosed in U.S. Pat. No. 4,067,171 and assigned to the assignee of this invention. U.S. Pat. No. 4,067,171, the disclosure of which is incorporated by reference, relates to a method of making a multiple enclosure mailer comprising a personalized envelope containing a plurality of separate personalized enclosures such as lettersheets, forms, return-mail applications and the like which have been prepared from two or more separate integral sheets. The two or more sheets are temporarily bonded in a mated configuration by crimping or gluing along a portion of the longitudinal edges of the sheets following form printing. The joining of the sheets in this manner eliminates mismatching of personalized sheets that had troubled the direct mail industry. The sheets remain joined along their longitudinal edge portions during further processing steps. Prior to insertion into the envelope pocket formed by sheet folding, the joined edge portions are trimmed away to separate the sheets from one another. The sheets are cut along a transverse fold line prior to envelope flap sealing to provide the plurality of personalized enclosure pages.

U.S. Pat. No. 4,067,171 represents an improvement in the art of personalized mailing devices disclosed in U.S. Pat. No. 3,557,519, also assigned to the assignee of the subject invention. U.S. Pat. No. 3,557,519, the disclosure of which is incorporated by reference, relates to a method of preparing an addressed envelope containing a single separate personalized lettersheet from an integral envelope letter sheet of paper formed from a continuous paper web.

In the preparation of an article for mailing comprising an envelope, at least one enclosure sheet and a return reply card meeting applicable postal regulations in accordance with the methods known to the prior art, it was necessary to either (1) separately prepare all of the personalized enclosures and reply card and then insert them serially or in an assembled packaged into the envelopes; or (2) utilize the method of U.S. Pat. No. 4,067,171 and thereafter insert a separate reply card into the envelope which already contained the separate letter sheets. Special handling of the reply card was necessary due to regulations of the U.S. Postal Service (U.S.P.S.) or other local postal authorities establishing minimum size and paper-weight standards for such articles, thereby necessitating formation of the reply card from paper stock heavier in weight (and therefore more costly) than that used for conventional direct mailings. It will be appreciated that the additional expense incurred in such mailing resulting from preparation of the heavier weight reply card, as well as the special handling required for its insertion into the envelope, adds significantly to the overall cost of a direct mail campaign, and particularly to the expense of larger campaigns which typically can involve the mailing of a million or more articles.

The use of a personalized return reply card in a mass mailing article is desirable not only because it reduces the cost of preparation of the mail article (as opposed to providing a sheet reply form and a return envelope), but also because it expedites handling by the recipient and simplifies record keeping by the sender.

SUMMARY OF THE INVENTION

The present invention provides a continuous commercial method for producing articles suitable for mailing comprising an envelope containing at least one separate enclosure sheet and a separate reply card, such as a postcard stock that is suitable for mailing, all of which are produced from one or more webs of lighter weight paper. The method therefore avoids the separate steps of preparing a reply card of a different weight paper stock and inserting the card into the envelope.

In one embodiment, the method of the invention broadly encompasses the steps of joining in a mated configuration a first form printed integral sheet section of conventional letter weight paper stock from which an envelope, separate enclosure sheet and a first section such as the front or back side of the reply card are subsequently formed, and a second form printed integral sheet section of conventional letter weight paper stock from which a plurality of enclosure sheets and the second section such as the back or front side of the reply card are subsequently formed, the mated reply card sections thereby forming a reply card, folding the mated integral sheets in a prescribed sequence and configuration, joining the front and back panel portions of the envelope and, while the envelope flap is open, separating the enclosure sheets and bonded double weight reply card along one of the prescribed fold lines to produce an envelope containing multiple separate enclosure sheets and a mailable reply card. A mailing article having a greater number of pages can be made by inserting one or more additional letter sheet pages between or adjacent the first and second integral sheet sections prior to folding. In a preferred aspect of the invention, at least one of the enclosure sheets and the reply card is personalized.

In another embodiment, the method of the invention provides for the formation of a direct mail article comprising a preprinted, personalized letter sheet, reply postcard and envelope formed from a single sheet section of light weight paper stock. The reply postcard is formed by folding one of the reply postcard sections toward the other and gluing or crimping them together to form a double thickness reply postcard meeting postal regulations. The sheet section is then further folded in a prescribed sequence and configuration, and the letter sheet and envelope are separated from one another along one of the prescribed fold lines prior to envelope sealing. The reply postcard can also be separated from the letter sheet prior to envelope sealing, or can be arranged to be detachably connected to the letter sheet for removal by the recipient of the mail article.

The disclosed method has the particular advantage of providing for the rapid preparation of large numbers of mail articles, each of which comprises an envelope having at least one separate enclosure sheet (which can optionally be personalized) and a personalized reply card, thereby essentially eliminating mismatching of the personalized enclosure sheets and reply cards. For example, should a government agency require up-dated personal information from a large number of individuals, the method of the invention can be employed to transmit in a sealed envelope an instruction or advice letter along with a form printed reply card with the individual's name and address printed thereon. After the required information is incorporated onto the reply card by the recipient, the card can be sent back to the agency for entry into the agency's records. Since the returned card includes the individual's printed name and address, potential problems concerning the identity of the individual and legibility of handwriting are avoided. The use of a form printed reply card also improves the likelihood of a prompt response by the recipient, since use of a unitary form printed reply card (typically involving the designation of one or more selection boxes and depositing in the mail) is easier than is use of a conventional 2-piece letter and envelope reply mailing device, which can easily become separated from one another following receipt by the recipient.

A further advantage of the method of the invention is that the separate enclosures and reply card all have the same orientation and can be removed from the envelope by the recipient in a nested configuration. This arrangement of the enclosures increases the likelihood that the recipient will read or inspect the enclosures in the order desired by the sender and complete the reply card thereafter. The provision of pre-printed return postage on the reply card further enhances the likelihood that the recipient will respond.

The methods of the invention can readily be adapted to producing the articles desired in a variety of sizes and formats which are within the capabilities of commercial lithographic and computer directed printers, and the folding and converting equipment which is available in the art.

Additional specific uses and advantages of the various formats which can be embodied in the methods of the invention will be apparent to those familiar with the art in view of the teachings of this specification.

BRIEF DESCRIPTION OF THE DRAWINGS

In the drawings accompanying and forming part of this specification.

DETAILED DESCRIPTION OF THE PREFERRED EMBODIMENTS

Figure 1A:
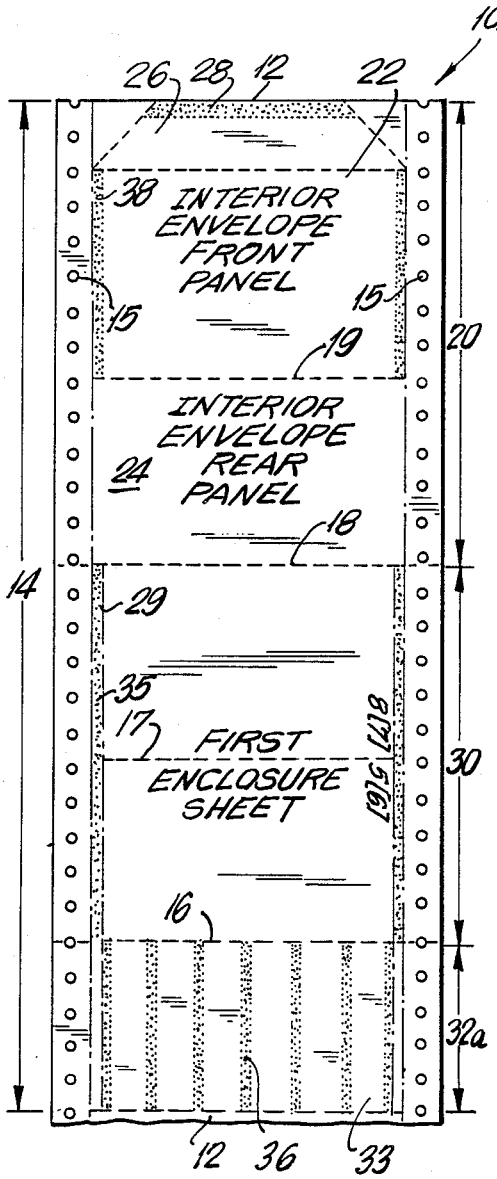
FIG. 1A is a plan view of a preferred embodiment of the invention showing a section of continuous paper web containing the envelope sheet, a first enclosure sheet and a first reply card section.

Referring to the drawings in detail, wherein like reference characters designate corresponding parts throughout the several figures, and particularly to FIG. 1A, there is shown web 10A which is divided by transverse perforated separation lines 12 into repeating composite sheet units 14.

Figure 1B:
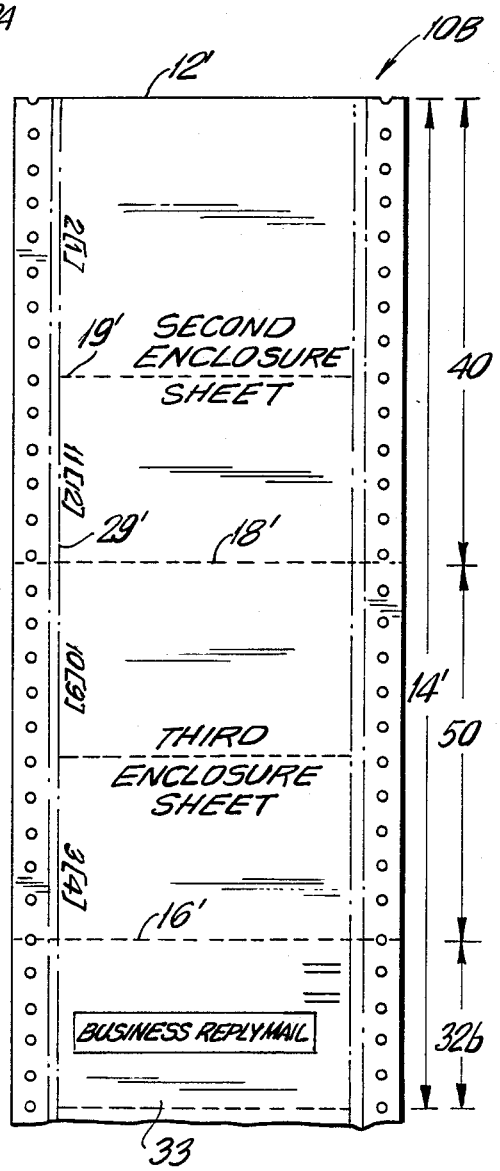
FIG. 1B is a plan view showing a section of continuous paper web containing additional enclosure sheets and a second reply card section to be mated with the first reply card section of FIG. 1A.

In FIG. 1B, there is shown web 10B which is likewise divided by transverse perforated separation lines 12' into repeating composite sheet units 14'.

Webs 10A and 10B are continuous forms, preferably lithographic webs having tractor feed line holes 15 for engagement by a computer directed printer for high speed feeding and proper indexing of the forms for insertion of personalization data, as will be described in more detail in connection with FIG. 2. Webs 10A and 10B are also preferably provided with transverse perforated fold lines 16–19 and 16'–19', respectively, to facilitate fan folding, as is described in greater detail below.

As shown in FIG. 1A, the composite sheet 14 comprises: an envelope sheet 20 including a front panel 22, back panel 24 and envelope flap 26, to which a remoistenable gum adhesive 28 can be applied; first enclosure sheet 30; and a front (or rear) section **32*a* of a reply card 33. Envelope sheet 20 and first enclosure sheet 30 are integrally formed, being joined along perforated folding line 18. First enclosure sheet 30 and front (or rear) section 32***a* of reply card 33 are integrally formed, being joined along transverse fold line 16.

As shown in FIG. 1B, the composite sheet 14' contains a second enclosure sheet 40, a third enclosure sheet 42, and the rear (or front) section 32*b* of the reply card 33. Second and third enclosure sheets 40 and 50, respectively, are integrally formed and are joined to one another along transverse perforation fold line 18'. Third enclosure sheet 50 and rear (or front) section 32*b* of the reply card 33 are integrally formed and are joined along the transverse fold line 16'. Envelope sheet 20, enclosure sheets 30, 40 and 50, and reply card sections 32*a* and 32*b* are dimensioned in such a way that by properly indexing the webs 10A and 10B, as by use of the line holes 15, the preprinted and personalized composite sheets 14 and 14' can readily be aligned in a superposed configuration such that composite sheet 14' overlies composite sheet 14. The composite sheets 14 and 14' are preferably arranged so that reply card section 32*b* overlies reply card section 32*a*, third enclosure sheet 50 overlies first enclosure sheet 30, and second enclosure sheet 40 overlies envelope sheet 20. The superposed sheets are thereafter advanced as a unit for further processing, as described below.

Figure 2:
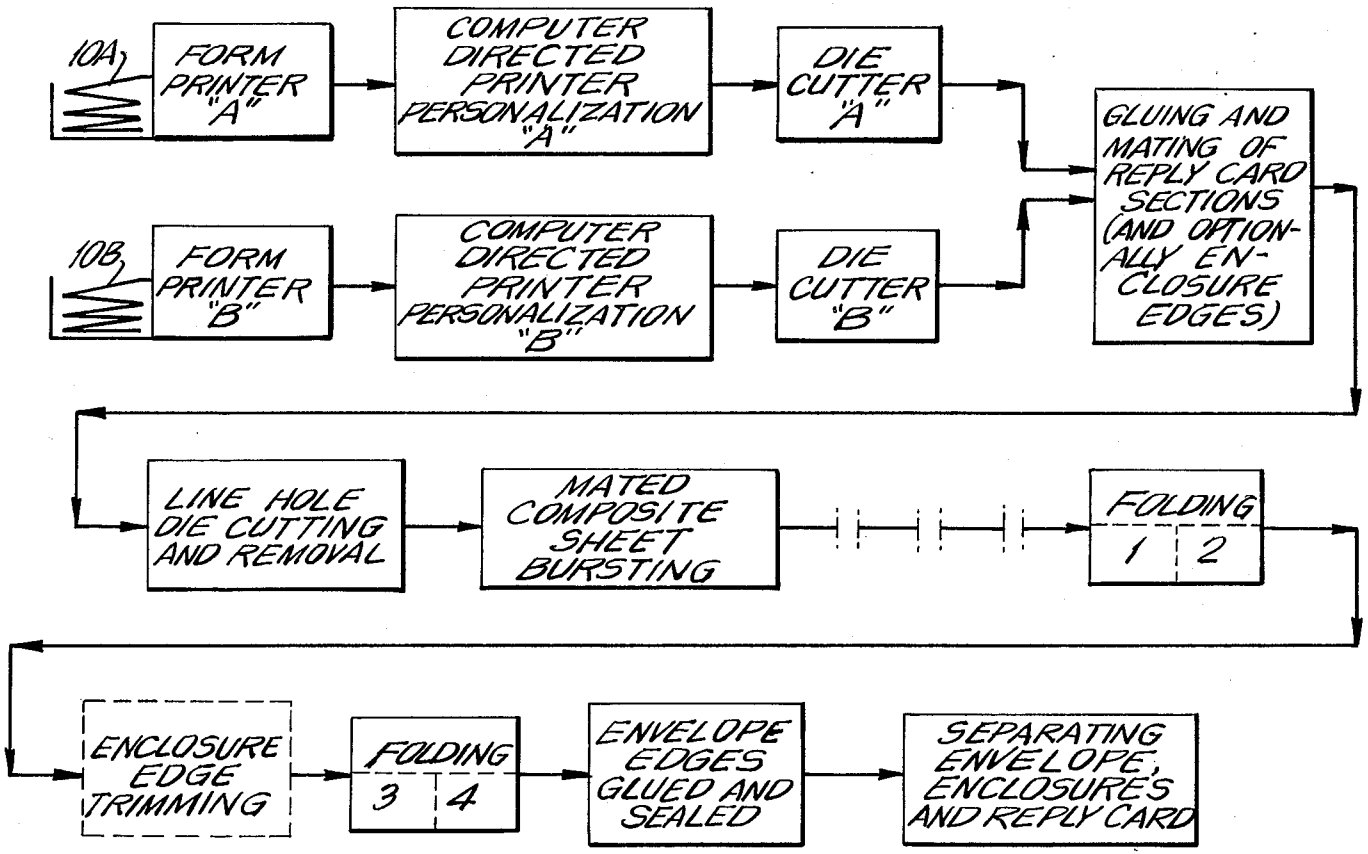
FIG. 2 is a schematic representation of the steps and operations employed in the practice of the method of the invention.

There is shown in FIG. 2 a schematic diagram illustrating generally the steps employed in practicing the preferred embodiments of the invention. From the previous description, it will be understood that blank web 10A is fed into Form Printer "A" which is preferably a lithographic press capable of printing, for example, a form letter appropriately positioned to correspond to the fields of first enclosure sheet 30 of FIG. 1A. In a similar fashion, web 10B is fed into Form Printer "B" which prints the fields of enclosure sheets 40 and 50 of FIG. 1B. It will be appreciated that one or both sides of its of the enclosure sheets 30, 40 and 50 can be printed by the respective form printers.

The composite sheets of the respective continuous webs exiting from the respective Form Printers "A" and "B" are then indexed and fed into Computer Directed Printers "A" and "B" for personalization. Conventionally, envelope sheet 20 will be printed with the name and address of the intended recipient and, if first enclosure sheet 30 is in a letter format, as is preferred in the practice of the present invention, the name and address of the same individual can be entered, and a personalized salutation printed. Any other desired personal data references, such as age, gender or employment, can be added to appropriate positions of the body of the letter. Similarly, second and third enclosure sheets 40 and 50, respectively, can be personalized. In addition, it is desirable to personalize at least one of the sections 32*a*, 32*b* of the reply card 33 with the recipient's complete name and address. For example, with reference to FIGS. 1A and 1B, it would be desirable to print the recipient's name and address on the back side (not shown) of reply card section 32*a*. Thus, when the reply card sections are bonded in the manner set forth below, personal data of the recipient is visible on the outer surface of the reply card 33.

As the webs 10A and 10B exit the Computer Directed Printer "A" and "B", they can optionally be fed into Die Cutters "A" and "B", respectively. Referring to FIGS. 1A and 1B, the envelope flap 26 can at this point be die cut to provide the desired depicted tapered flap configuration. In addition, the longitudinal margins of the enclosure sheets and reply card sections can be die cut to provide a narrow width relative to that of the envelope sheet 20 to facilitate subsequent bursting and folding steps described below.

As the webs 10A and 10B exit the optional die cutters, beads or lines of adhesive are applied to at least one of the opposing faces of reply card sections 32*a* and 32*b* and optionally along one of the enclosure sheets just inside of its longitudinal edges in the manner disclosed in U.S. Pat. No. 4,067,171 referred to above. Referring once again to FIGS. 1A and 1B, beads of adhesive 36 are applied in generally parallel, spaced rows along the face of reply card section 32*a* which will later bond with the corresponding opposed face of reply card section 32*b* to form a reply card 33 having sufficient weight and rigidity to meet prescribed postal regulations. While rows of adhesive 36 are depicted along only one of the opposing reply card section faces, it can be appreciated that the adhesive could instead be applied to the opposing face of the other reply card section 32*b*, or, alternatively, to both reply card sections and in any prescribed pattern sufficient to insure bonding of the reply card sections 32*a* and 32*b* to one another. Since the adhesive also adds to the weight and rigidity of the final reply card, specific adhesives and their patterns of application can be selected to substantially increase the apparent weight and stiffness of the card. Additionally, optional adhesive beads 35 can be applied adjacent the opposite longitudinal edges of one or more of the enclosure sheets, such as first enclosure sheet 30, as shown in FIG. 1A. The adhesive 35 and 36 can be of the pressure-sensitive variety well known in the art. Following application of the adhesive 36 (and optionally adhesive 35), webs 10A and 10B are then brought into an aligned, superposed mating configuration and pressed together as by passing them through pressure rolls, so that they are joined and bonded by the adhesive 36 of the reply card 33 and optionally by the adhesive 35 along first enclosure sheet 30. Alternatively, in lieu of mating with the adhesive, reply cards sections 32*a* and 32*b* and enclosure sheets 30 and 50 can be joined by passing the respective composite sheet portions through appropriate crimping wheels or other crimping means known in the art, provided such crimping renders the reply card sections 32*a* and 32*b* relatively inseparable from one another.

It will be appreciated from the method outlined above that the printed personalized envelope, enclosure sheets and reply card sections are joined together from this point on during subsequent movements and folding operations. Joining the envelope and personalized enclosure sheets through bonding of the opposed reply card sections not only eliminates entirely any subsequent risk of mismatching, thereby reducing greatly the need for quality control checks on the finished products, but also results in the formation of a reply card meeting all applicable postal regulations that is formed from inexpensive light-weight paper stock. This method of joining the composite envelope, enclosure sheets and reply card sections also eliminates shifting and misalignment of the envelope panels 22 and 24 and enclosure sheets 30, 40 and 50 during subsequent high-speed folding operations.

Referring once again to the schematic diagram of FIG. 2, the mated and glued webs 10A and 10B are then fed into Line Hole Die Cutting Removal operation wherein the portions of the composite sheets 14 and 14' lying outside the longitudinal edges of the envelope and enclosure sheets are removed.

This last die cutting and removal step can preferably be accomplished by appropriately positioning slitting apparatus, such as cam-actuated slitting wheels, capable of making the necessary longitudinal cuts, and by then removing the opposite longitudinal edge portions of the webs 10A and 10B containing the line holes 15. The remaining portion of the joined web is then passed to the Mated Composite Sheet Bursting station where the continuous, superposed, mated sheets are preferably "burst" or separated along the transverse composite sheet-delineating lines 12 and 12'. Alternatively, the mated composite sheets can be guillotine cut along the sheet delineating lines 12 and 12', as disclosed in U.S. Pat. No. 3,557,519. Following bursting, the individual composite sheet units joined at the reply card 33 (and optionally along the longitudinal edges of enclosure sheets 30 and 50) are fed into a conventional multi-plate folding machine where four transverse folds are made along superposed fold lines 16 and 16', 17 and 17', 18 and 18', 19 and 19'. The sequence as well as the direction of folds is illustrated in FIGS. 3–6.

Figure 3:
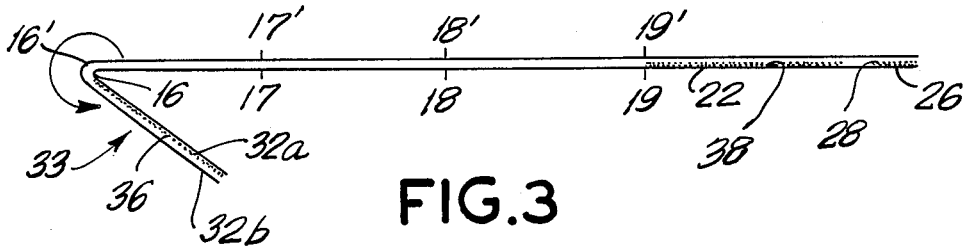
FIG. 3 is a side view showing the first folding step partially completed on the aligned and joined reply card, integrated envelope and first enclosure sheets and integral second and third enclosure sheets after die-cutting and bursting from the continuous paper web.

With reference to FIG. 3, mated reply card sections **32*a* and 32*b* are preferably folded transversely in the direction of the envelope panels along first transverse fold lines 16, 16'. While the mated reply card sections 32*a* and 32*b* can be folded in the opposite direction (toward second enclosure sheet 40), folding the card sections in the direction of the envelope panels as shown results in a mailing enclosure having a more desirable, book-like stacked configuration, as described in greater detail below in connection with FIG. 7**.

Figure 4:
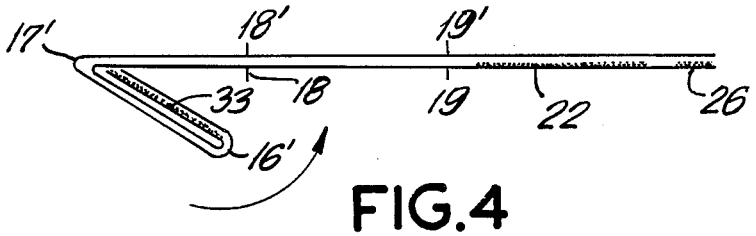
FIG. 4 is a side view of the elements shown in FIG. 3, illustrating the partially completed second folding step.

As shown in FIG. 4, the mated enclosure sheets are then folded along a second transverse fold line corresponding to perforated fold lines 17 and 17' toward the envelope panels. As shown in the drawing figure, reply card 33 is now interposed between the folded halves of the joined first and third enclosure sheets. In the preferred embodiment, fold lines 17 and 17' generally divide their respective enclosure sheets into upper and lower page half portions. Fold line 19' extending transversely across the second enclosure sheet 40 also divides the enclosure sheet 40 into upper and lower page half portions. While other folding arrangements can be utilized to provide different types of mailing enclosures, the present folding arrangement is utilized to provide a mailing enclosure as described in greater detail below which reads sequentially like the pages of a book.

Figure 5:
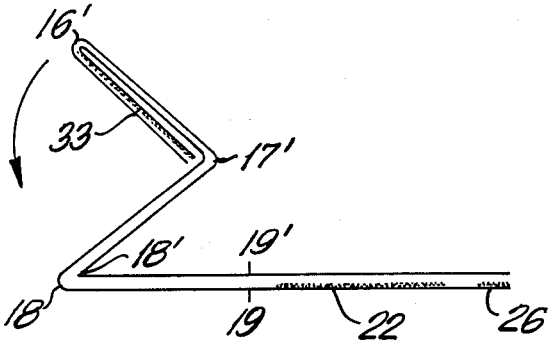
FIG. 5 is a side view of the elements shown in FIGS. 3 and 4, illustrating the partially completed third folding step.

The third fold, as illustrated in FIG. 5, is along generally superposed transverse lines 18 and 18' separating the first enclosure sheet 30 from the envelope sheet 20 and the third enclosure sheet 50 from the second enclosure sheet 40, respectively. As the third fold is made, the opposite longitudinal edges of optionally joined first and third enclosure sheets 30 and 50 are trimmed away along lines 29 and 29', as by a cutting wheel, and removed so that the transverse width of all of the enclosure sheets 30, 40 and 50 and the reply card 33 is approximately the same. This operation is depicted schematically in FIG. 2 in phantom as Enclosure Edge Trimming immediately prior to the step designated Folding 3 and 4. As will be understood with reference to the above description, this trimming completely removes those portions of the enclosure sheets which were glued adjacent their longitudinal edges. However, the composite sheet units 14 and 14' remain joined together at their respective reply card sections **32*a* and 32*b* which, together with their folded and nested configuration at this stage of processing precludes undesirable shifting or misalignment during subsequent processing steps. In the absence of optional joining of the enclosure sheets 30 and 50 adjacent their respective longitudinal edges, the portion of composite sheets 14 and 14' (including the reply card sections 32*a* and 32*b*) lying outside longitudinal cutting lines 29 and 29', respectively, can be removed during the step designated schematically in FIG. 2** as Mated Composite Sheet Bursting.

Figure 6:
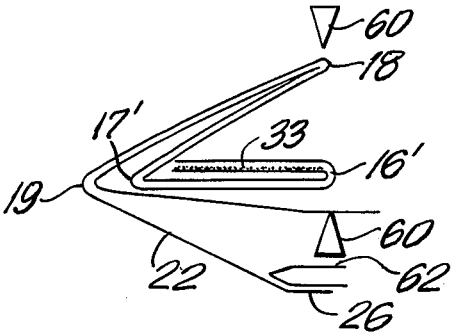
FIG. 6 is a schematic cut-away, sectional side view showing the step of simultaneously separating and trimming the reply card, enclosure sheets and the top edge of the rear envelope panel after the fourth folding step.

The fourth folding step, as shown in FIG. 6, is along transverse line 19 separating the front and rear envelope panels and corresponding transverse fold line 19' separating the second enclosure sheet 40 from the third enclosure sheet 50. This fourth folding step brings the rear envelope panel and attached enclosure sheets and reply card toward the front envelope panel and flap for final trimming and separation prior to envelope sealing.

As will be appreciated by persons familiar with the apparatus employed in the art, the various steps depicted in the schematic diagram of FIG. 2 can be combined or rearranged in order to accommodate the format of the composite sheets and the capabilities of the equipment available.

With continuing reference to FIG. 2, in the next step, designated by the box designated Envelope Edges Glued and Sealed, adhesive 38 (FIG. 1A) is applied along the opposite longitudinal edges of the inside of either the front or rear envelope panels 22 or 24, and the panel edges are brought into overlying alignment and pressure is applied to seal the opposite edges to form the envelope pocket containing the enclosure sheets 30, 40 and 50, and reply card 33, the latter still attached to the respective composite sheets.

Figure 7:
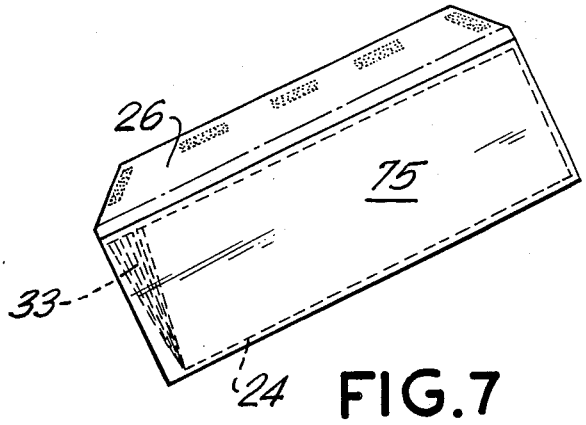
FIG. 7 is a perspective view showing in phantom the trimmed and folded enclosure sheets and reply card inserted in the envelope for mailing.

The final processing step, illustrated schematically in FIG. 2 as Separating Envelope, Enclosures and Reply Card, provides for separation of the reply card 33 from first and third enclosure sheets 30, 50 along superposed fold lines 16 and 16'. This step also provides for separation of the first and third enclosure sheets from the rear envelope panel 24 and second enclosure sheet 40, respectively, along generally superposed transverse fold lines 18 and 18'. Separation of the enclosures and reply card can advantageously be combined with the final trimming of the exposed edges appearing behind the front panel 22 of the envelope sheet 20, as shown in FIG. 6. It is apparent that this trimming step must be undertaken in connection with the illustrative embodiment depicted in the drawings in order to remove that portion of the second enclosure sheet 40 which overlaps the envelope flap 26 to permit sealing of the flap of the finished envelope. Enclosure sheet separation and trimming is advantageously accomplished by a slitting device comprising scissor slitting wheels 60 which is adjusted to the thickness of the paper stock to effect clean separation of the enclosure sheets and reply card from one another along or adjacent the fold lines 16, 16', 18 and 18' and to provide a nested or stacked configuration of enclosure sheets having a reply card 33 inserted therein, such that a book-like configuration of enclosure sheets is provided. Enclosure sheet separation and trimming is facilitated through the use of a flap deflector 62, which temporarily bends envelope flap 26 away from the slitting wheels 60 during the trimming operation. The resulting mailing article 75 is illustrated in FIG. 7 immediately prior to envelope flap sealing.

Figure 8:
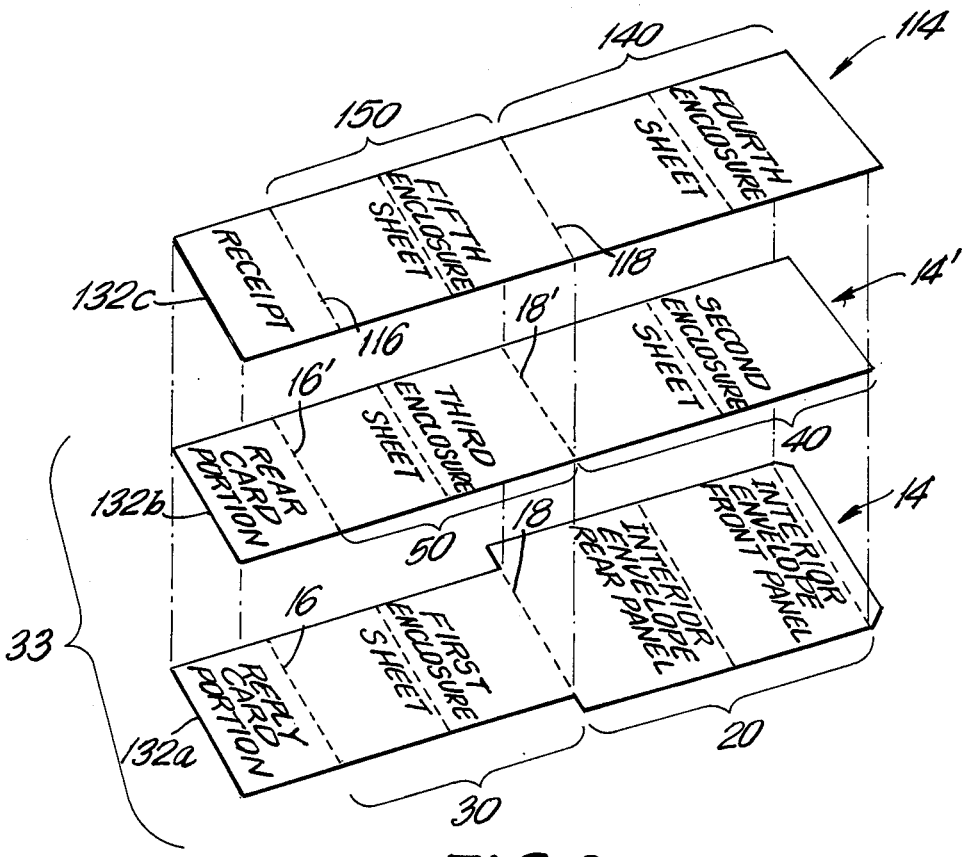
FIG. 8 is an exploded perspective view of a second embodiment showing the alignment for mating of two of the partially processed integral sheets of the type depicted in FIGS. 1A and 1B, and a third, partially processed integral sheet.

Depending upon the capacity of the lithographic and computer-directed printing equipment, and the desired size and volume of the envelopes and enclosures to the produced, a mailing article having a greater number of pages can be produced by, for example, including one or more additional composited sheets 114 adjacent composite sheets 14 and 14', as shown in FIG. 8. Preferably, any one or all of additional composite sheets 114 can be form printed and personalized in the manner set forth above for composite sheets 14 and 14'. In order to facilitate processing, additional composite sheets 114 preferably comprise enclosure sheets, such as the fourth and fifth enclosure sheets 140 and 150 joined along transverse fold line 118, and an excess portion such as that designated as 132c corresponding to reply device portions 132a and 132b of the reply device 133 joined to the fifth enclosure sheet 150 along transverse fold line 116 so that the overall length of the additional composite sheets 140 is the same as that of composite sheets 14 and 14'. Excess portion 132c can be form printed and personalized so as to form a receipt for a response entered on the reply card 133, or can be an unprinted blank that is removed prior to mailing to the intended recipient.

Figure 9:
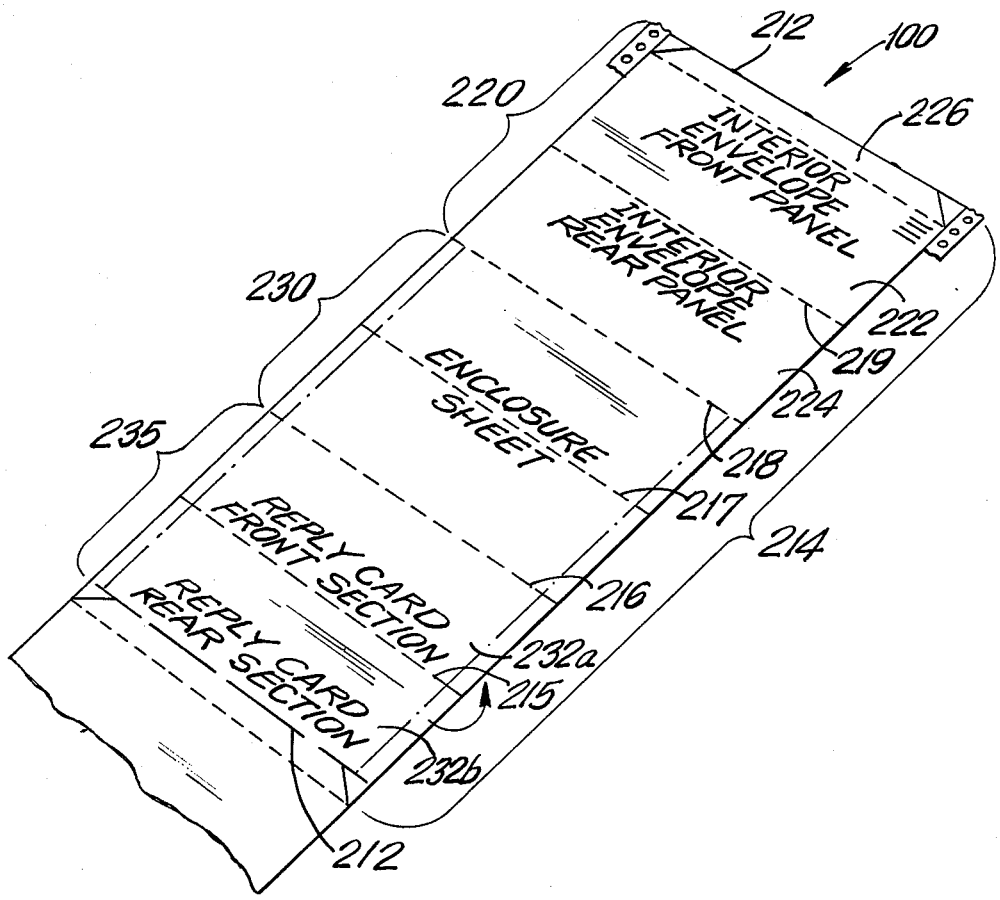
FIG. 9 is a plan view of a third embodiment showing a section of continuous paper web comprising an envelope sheet, a personalized enclosure sheet and front and back card sections.

With reference to FIG. 9, there is shown another embodiment of the invention in which the mailing article is formed from a single web 100 divided by transverse perforated cutting lines 212 into a plurality of repeating composite sheet units 214. Each of the composite sheet units 214 comprises an envelope sheet 220, a single enclosure sheet 230 and a reply card sheet 235 comprising a pair of reply card sections 232a and 232b connected to one another along fold line 215. Envelope sheet 220 comprises an envelope flap 226, and a front panel 222 joined to a rear panel 224. Processing of the composite sheet 214 proceeds in a manner similar to that described above in connection with composite sheet 14 and illustrated schematically in FIG. 2. However, instead of forming the reply card (not shown) by joining a reply card front (or back) section of composite sheet 214 to a reply card back (or front) section of another composite sheet, the reply card is formed by folding one of the reply card sections, such as back section 232b, along fold line 215 and gluing it to adjoining reply card front section 232a. Thereafter, the composite sheet 214 is folded along transverse lines 216, 217, 218, and 219 in the manner set forth above for mated composite sheets 14 and 14'. Prior to sealing the envelope flap 226, the enclosure sheet 230 is separated from the envelope back panel 224 along fold line 218 in a conventional manner. The reply card can be arranged to be detachably connected to enclosure sheet 230 by providing slit perforations along fold line 216 to permit for easy detachment by the recipient, or it can be separated from the enclosure sheet 230 in the manner discussed in the other embodiments prior to envelope sealing.

The specific embodiments described above are intended to be representative and illustrative of the method of the invention which can be modified without departing from the spirit and scope of the invention set forth by the following claims.

What is claimed:

1. A method of forming a direct mail article (75) having a plurality of enclosure sheets (30, 40, 50) and a composite postcard reply device (33), comprising the steps of:

a. mating in a superposed aligned configuration a first composite sheet (14) comprising:

i. an envelope sheet (20) defining a flap (26) and a front panel (22) joined to a rear panel (24) along a transverse envelope panel fold line (19);

ii. a first enclosure sheet (30) joined to the rear panel (24) along a first transverse fold line (18); and iii. a postcard reply device front section (32a) for forming the composite postcard reply device (33), the reply device front section (32a) being joined to the first enclosure sheet (30) along a second transverse fold line (16); and a second composite sheet (14') comprising integral second (40) and third (50) enclosure sheets joined along a first transverse fold line (18') and a postcard reply device rear section (32b) joined to the third enclosure sheet (50) along a second transverse fold line (16'), the first and second transverse fold lines (18', 16') of the second composite sheet (14') being superposed over the first and second transverse fold lines (18, 16) of the first composite sheet;

b. bonding the front and rear postcard reply sections (32a, 32b) together to form the composite postcard reply device (33) and thereby maintain the mated configuration of the composite sheets (14, 14');

c. folding the bonded postcard reply device (33) and attached enclosure sheets (30, 50) to position them between the front and rear panels (22, 24) of the envelope sheet (20) so that the bonded postcard reply device (33) and enclosure sheets (30, 40, 50) are in an overlying configuration;

d. bonding the longitudinal edges of the front and rear envelope panels (22, 24) to form an envelope pocket containing the bonded postcard reply device (33) and enclosure sheets (30, 40, 50); and e. while the envelope flap (26) is open, separating the bonded postcard reply device (33) from the first (30) and third enclosure (50) sheets, the second (40) and third (50) enclosure sheets from one another, and the first enclosure sheet (30) from the envelope sheet (20).

2. The method of claim 1 wherein the step of folding the bonded postcard reply device (33) and attached enclosure sheets (30, 50) between the front (22) and rear (24) envelope panels is accomplished as follows:

a. folding the bonded postcard reply device (33) in the direction of the envelope flap (26) along the second transverse lines (16, 16') joining the bonded postcard reply device (33) to the superposed ends of the first (30) and third (50) enclosure sheets;

b. folding the bonded postcard reply device (33) and first (30) and third (50) enclosure sheets toward the envelope flap (26) along an intermediate transverse line (17, 17') extending across the superposed first (30) and third (50) enclosure sheets;

c. folding the bonded postcard reply device (33) and folded first (30) and third (50) enclosure sheets toward the second enclosure sheet (40) along the first transverse lines (18, 18') joining the second enclosure sheet (40) to the third enclosure sheet (50) and the first enclosure sheet (30) to the rear envelope panel (24); and d. folding the bonded postcard reply device (33) and folded first (30) and third (50) enclosure sheets toward a free end of the second enclosure sheet (40) along the transverse envelope panel fold line (19).

3. The method of claim 1 wherein the first (14) and second (14') composite sheets each form a part of separate continuous paper webs (10A, 10B).

4. The method of claim 1 wherein the reply device (33) is personalized.

5. The method of claim 1 wherein the envelope front panel (22) and first enclosure sheet (30) are personalized.

6. The method of claim 5 wherein at least one of the second (40) and third (50) enclosure sheets is personalized.

7. The method of claim 1 wherein the front (32*a*) and rear (32*b*) postcard reply device sections are bonded together by adhesive (36).

8. The method of claim 1 wherein the front (32*a*) and rear (32*b*) postcard reply device sections are bonded together by crimping.

9. The method of claim 1 which further includes the step of sealing the envelope flap (26) to the rear envelope panel (24) to thereby provide an envelope containing multiple separate enclosure sheets (30, 40, 50) and a bonded postcard reply device (33), the envelope being suitable for mailing.

10. The method of claim 1 wherein the step of bonding the postcard reply sections (32*a*, 32*b*) together further comprises the step of temporarily bonding at least one superposed pair of enclosure sheets (30, 50) along their opposite longitudinal edges.

11. The method of claim 10 wherein the bonded opposite longitudinal edges of the superposed enclosure sheets (30, 50) are removed prior to separation of the bonded postcard reply device (33) from the first (30) and third (50) enclosure sheets.

12. The method of claim 1 wherein the bonded postcard reply device (33) is separated from the first (30) and third (50) enclosure sheets, the second (40) and third (50) sheets are separated from one another, and the first enclosure sheet (30) is separated from the envelope sheet (20) by scissor wheel cutting along the superposed second fold lines (16, 16') of the first (30) and second (50) enclosure sheets.

13. A method of forming a direct mail article (75) having a plurality of separate enclosure sheets (30, 40, 50, 140, 150) and a composite postcard reply device (133), comprising the steps of:

a. mating in a superposed aligned configuration first (14), second (14') and third (114) composite sheets, the first composite sheet (14) comprising:
   i. an envelope sheet (20) defining a flap (26) and a front panel (22) joined to a rear panel (24) along a transverse envelope panel fold line (19);
   ii. a first enclosure sheet (30) joined to the rear panel (26) along a first transverse fold line (18); and
   iii. a postcard reply device front section (132*a*) for forming the postcard reply device (133), the postcard reply device front section (133*a*) being joined to the first enclosure sheet (30) along a second transverse fold line (16);

the second composite sheet (14') comprising integral second (40) and third (50) enclosure sheets joined along a first transverse fold line (18') and a postcard reply device rear section (132*b*) joined to the third enclosure sheet (50) along a second transverse fold line (16'), the third composite sheet (114) comprising integral fourth (140) and fifth (150) enclosure sheets joined along a first transverse fold line (118), the postcard reply device front (132*a*) and rear (132*b*) sections and the first transverse fold lines (18, 18', 118) of the first (14), second (14') and third (114) composite sheets being superposed over one another;

b. bonding the postcard reply front (132*a*) and rear (132*b*) sections together to form the composite postcard reply device (133);

c. folding the bonded postcard reply device (133) and the enclosure sheets (30, 40, 50, 140, 150) of the first (14), second (14') and third (114) composite sheets to position them between the front (22) and rear (24) panels of the envelope sheet (20) so that the bonded postcard reply device (133) and enclosure sheets (30, 40, 50, 140, 150) are in an overlying, stacked configuration;

d. bonding the longitudinal edges of the front (22) and rear (24) envelope panels to form an envelope pocket containing the bonded postcard reply device (133) and enclosure sheets (30, 40, 50, 140, 150); and e. while the envelope flap (26) is open, separating the bonded postcard reply device (133) from the first (30) and third (50) enclosure sheets, the second (40) and third (50) adjoining enclosure sheets and the fourth (140) and fifth (150) adjoining enclosure sheets from one another, and the first enclosure sheet (30) from the envelope sheet (20).

14. The method of claim 13 wherein the first composite sheet (30) and at least one of the enclosure sheets (40, 50, 140, 150) comprising the second (14') and third (114) composite sheets is personalized.

15. The method of claim 13 wherein the front (132*a*) and rear (132*b*) postcard reply device sections are bonded together by adhesive.

16. The method of claim 13, wherein the front (132*a*) and rear (132*b*) postcard reply device sections are bonded together by crimping.

17. The method of claim 13 which further includes the step of sealing the envelope flap (26) to the rear envelope panel (24) to thereby provide an envelope containing multiple separate enclosure sheets (30, 40, 50, 140, 150) and a separate postcard reply device (133), the envelope being suitable for mailing.

18. The method of claim 13 wherein the third composite sheet (50) comprises an end section (132*c*) corresponding to the front (132*a*) and rear (132*b*) reply device sections of the first (14) and second (14') composite sheets, the end section (132*c*) being detachably connected to the third composite sheet (114) and aligned in a superposed configuration with the front (132*a*) and rear (132*b*) reply device sections.

19. The method of claim 18 wherein the end section (132*c*) comprises a form printed receipt.

20. The method of claim 13 wherein the step of bonding the postcard reply sections (132*a*, 132*b*) together further comprises the step of temporarily bonding together along their opposite longitudinal edges at least one enclosure sheet (30, 40, 50, 140, 150) from each of the superposed composite sheets (14, 14', 114).

21. The method of claim 20 wherein the bonded opposite longitudinal edges of the superposed enclosure sheets (30, 40, 50, 140, 150) are removed prior to separation of the bonded postcard reply device (133) from the first (30) and third (50) enclosure sheets.

22. The method of claim 13 wherein the bonded postcard reply device (133) is separated from the first (30) and third (50) enclosure sheets, the second (40) and third (50) adjoining enclosure sheets and the fourth (140) and fifth (150) adjoining enclosure sheets are separated from one another, and the first enclosure sheet (30) is separated from the envelope sheet (20) by scissor wheel cutting.

23. A method of forming a direct mail article (75) having a personalized enclosure sheet (230) and a double weight detachable postcard reply device satisfying prevailing postal regulations from a single continuous web (100) of paper stock, comprising the following steps:

a. form printing a composite sheet (214) comprising:
   i. an envelope sheet (220) defining a flap (226) and a front panel (222) joined to a rear panel (224) along a transverse envelope panel fold line (219);
   ii. an enclosure sheet (230) joined to the rear envelope panel (224) along a first transverse fold line (218); and
   iii. a postcard reply device sheet (235) comprising adjoining front (232*a*) and rear (232*b*) postcard sections detachably joined to the enclosure sheet (230) along a second transverse fold line (216);
b. mating said front (232*a*) and rear (232*b*) postcard reply sections by folding them into a superposed position along a transverse fold line (215) joining the front (232*a*) and rear (232*b*) postcard reply sections;
c. bonding the mated front (232*a*) and rear (232*b*) postcard reply sections together to form the postcard reply device;
d. folding the bonded postcard reply device and attached enclosure sheet (230) to position them between the front (222) and rear (224) panels of the envelope sheet (220) so that the postcard reply device and enclosure sheet (230) are in an overlying, stacked configuration;
e. bonding the longitudinal edges of the front (222) and rear (224) envelope panels to form an envelope pocket containing the postcard reply device and enclosure sheet (230); and
f. while the envelope flap (226) is open, separating the enclosure sheet (230) from the envelope sheet (220).

24. The method of claim 23 which further includes the step of separating the postcard reply device from the enclosure sheet (230).

25. The method of claim 23 wherein the postcard reply device is detachably connected to the enclosure sheet (230) along a perforated line (216).

26. The method of claim 23 wherein the front (232*a*) and rear (232*b*) postcard reply sections are bonded together by adhesive.

27. The method of claim 23 wherein the front (232*a*) and rear (232*b*) postcard reply sections are bonded together by crimping.

28. The method of claim 23 wherein the postcard reply device is personalized.

29. The method of claim 23 wherein the step of folding the bonded postcard reply device and attached enclosure sheet (230) between the front (222) and rear (224) envelope panels is accomplished as follows:

a. folding the bonded postcard reply device in the direction of the envelope flap (226) along the second transverse fold line (216);
b. folding the bonded reply device and enclosure sheet (230) toward the envelope sheet (220) along an intermediate transverse line (217) extending across the enclosure sheet (230) between the second (216) and first (218) transverse fold lines;
c. folding the bonded postcard reply device and enclosure sheet (230) along the first transverse fold line (218); and
d. folding the bonded reply device and enclosure sheet (230) along the transverse envelope fold line (219) joining the front (222) and rear (244) envelope panels.

30. The method of claim 29 wherein the folding steps are in the same direction.

31. The method of claim 23 wherein the enclosure sheet (230) is separated from the envelope sheet (220) by scissor wheel cutting.

32. The method of claim 23 wherein the postcard reply device is separated from the enclosure sheet (230) and the enclosure sheet (230) is separated from the envelope sheet (220) by scissor wheel cutting.

* * * * *